United States Patent [19]

Pasbrig

[11] 4,049,115

[45] Sept. 20, 1977

[54] COIN HOLDER

[75] Inventor: Max Pasbrig, Orselina, Ticino, Switzerland

[73] Assignee: Lacrex Brevetti S.A., Minusio, Switzerland

[21] Appl. No.: 693,700

[22] Filed: June 7, 1976

[30] Foreign Application Priority Data

June 25, 1975 Germany ..... 2528324

[51] Int. Cl.[2] ..... A45C 11/28; A45C 1/02

[52] U.S. Cl. ..... 206/.84

[58] Field of Search ..... 206/.8, .84, 443

[56] References Cited

U.S. PATENT DOCUMENTS 3,606,008 9/1971 Lusetti ..... 206/.84

FOREIGN PATENT DOCUMENTS 1,526,603 4/1968 France ..... 206/.8

*Primary Examiner*—George T. Hall

*Attorney, Agent, or Firm*—Werner W. Kleeman

[57] ABSTRACT

A holder to receive a number of coins and the like which are stacked on top of one another wherein a cylindrical casing bounded at both ends and with an internal cross-section corresponding to the outer contour of the coins to be inserted, has a longitudinal slot extending over the whole length of the casing, the width of which is less than the diameter of each coin. This longitudinal slot is enlarged at least at one of the ends of the casing to form a gripping opening surrounded by a located edge or rim forming the end face, boundary or limit, and the walls and rims of the casing are, at least in part, made of a flexible material to enable the longitudinal slot to expand, at least in places, to the width of the coin.

7 Claims, 4 Drawing Figures

COIN HOLDER

BACKGROUND OF THE INVENTION

The invention concerns a holder to receive a number of coins and the like, stacked on top of one another.

In the handling of cash, coins of equal value are frequently made up in pre-determined quantities, stacked and then wrapped in the form of a roll in a paper wrapping. While it is true that these rolls of coins simplify the storage and transport of given coin denominations or specie, it is none the less a laborious and time-consuming task to make up these rolls. A further disadvantage is that while these rolls of coins present a reasonable guarantee of the presence of all the counted out coins when they are unopened, opened and in complete rolls invariably involve a recount of the contents in order to determine the total value of a roll. Finally, a paper wrapping, once it has been torn open, can no longer be re-used as a container.

SUMMARY OF THE INVENTION

The object of the invention is therefore to provide a coin holder which is as simple and cheap as possible to manufacture, which simplifies to a marked extent the making up, counting and control of the coins and which can be re-used and often as required.

To meet this requirement, the coin holder in accordance with the invention is characterised by the fact that a cylindrical casing, bounded at both ends and with an internal diameter corresponding to the outer contour of the coin, has a longitudinal slot extending over the whole length of the casing, the width of this slot being less than the diameter of the coin, that this slot is enlarged at at least one of the ends of the casing to form a gripping opening surrounded by a locating edge forming the end face limit, and that the walls and rims of the housing are, at least in part, made of a flexible material to enable the longitudinal slot to expand to the width of the coin.

With a view, in particular, to simplifying the insertion of a complete roll of coins into the holder, the longitudinal slot is bounded by feed strips.

It has been found desirable to provide the cylindrical casing with inspection apertures so that the contents of the holder can always be checked. This is made even more simple by markings on the casing.

Such a coin holder is simple and cheap to manufacture. Being made of plastic, it is very light in weight. On the other hand, it is almost unbreakable, and can consequently be used as often as required. Filling of this holder is also extremely simple because the coins can be inserted either singly or in groups through the longitudinal slot. The same applies to extraction. A further advantage is that the contents are always visible and the total value can be quickly determined.

BRIEF DESCRIPTION OF THE DRAWINGS

The drawing depicts various embodiments of a coin holder in accordance with the invention. It shows.

DETAILED DESCRIPTION OF THE PREFERRED EMBODIMENTS

Figure 1:
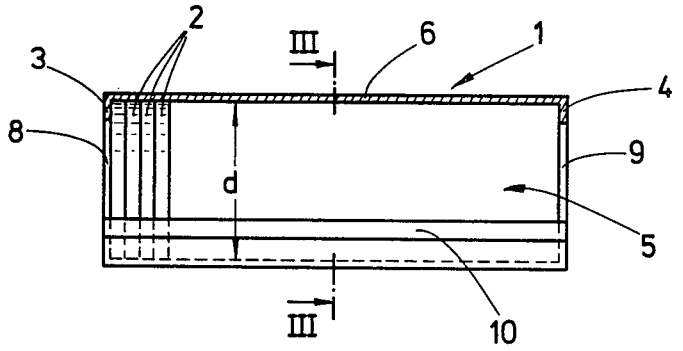
FIG. 1 a view from above, partly in section.
Figure 2:
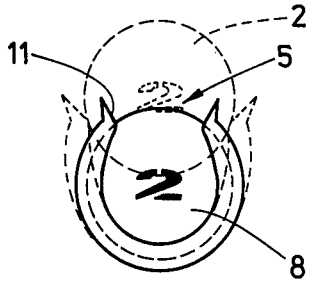
FIG. 2 an end view

The holder illustrated in FIGS. 1 and 2 consists of a cylindrical casing 1, the inner cross-section of which corresponds to the outer contour of the coins 2 to be inserted, and the rims 3, 4 at the opposite ends of the casing 1 forming end face limits or boundaries. The cylindrical casing 1, which can be in the form of an enclosed or solid (FIG. 1) casing wall 6 or also of a casing wall with inspection apertures 15 (FIG. 3), has a longitudinal slot 5 extending along the entire length of the casing which goes on, without a break, to form the gripping openings 8, 9 in the end faces. In the normal position, the longitudinal slot 5 has a width w considerably smaller than the diameter d of the inside of the casing 1 and thus of the coin 2. It follows that it is possible to insert coins into this longitudinal slot 5, or to withdraw them through it only in a tilted position. However, because it is possible to tilt the coins only when the holder is not full, the longitudinal slot 5 is made so that it can be opened up to a width corresponding to the diameter d of the coin (FIG. 2, broken line position). For this purpose, it is desirable for the holder to be made of a flexible plastic material which is sufficiently deformable to enable the longitudinal slot to be expanded, either partly or along its whole length, to the diameter of the coins. To simplify widening of the longitudinal slot and also the insertion of the coins, the edges of the longitudinal slot have feed strips 10 or equivalent structure, the guide surfaces 11 of which open outwards to form sliding surfaces for the coins to be inserted. By this means it is possible to insert into the holder, simply by pressing it open, a roll of coins made up in an ordinary cash collecting plate.

Figure 3:
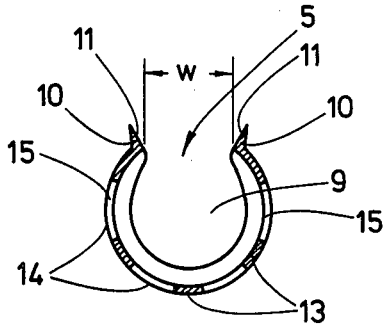
FIG. 3 a section through the line III—III in FIG. 1, but with a basketshaped casing.

In order that the coins may be visible not only through the longitudinal slot 5, it is advisable, as shown in FIG. 3, for the cylindrical casing to be in the form of a basket consisting of longitudinal strips 13 and transverse strips 14. The contents of this holder can then be seen from all sides through the resultant inspection apertures 15. FIGS. or other markings made on the wall of the casing or on the longitudinal or transverse strips can also serve as a scale for counting the coins contained in the holder.

Figure 4:
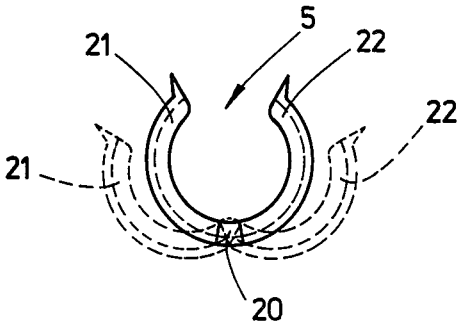
FIG. 4 an end view of another holder.

It is also possible for the flexibility of the material of which the casing is made to extend only to a strip sector of the casing. An example of this is shown in FIG. 4, where a flexible bending zone 20 is formed on the side opposite the longitudinal slot 5, which extends over the entire length of the casing and the limit edges or rims 3, 4 and holds together the two halves 21, 22 of the casing, which in this case may be made of a hard material. The halves of the casing can be opened and closed by means of this bending zone 20. The flexibility of this bending zone presses the halves into the closed position. Finally, the flexible bending zone can also be replaced by a hinge formed of one of the two halves 21, 22 (not shown), acting in conjunction with a locking spring.

In order to prevent coins from falling of their own accord out of an only partly filled holder through the longitudinal slot, the cylindrical casing is adjusted to the coins by a firm press fit, so that once coins have been inserted, they do not so easily come loose.

The invention is not limited to the form of construction described. For example, the holder can be of any other cross-sectional shape, according to the coins to be inserted. The wall of the casing, instead of being latticed or basked-shaped, can also be perforated. Finally, the holder could be partly or completely closed at one end face. In addition, it is not essential for the outer surface of the cylindrical casing to be coaxial with the inner surface, and thus with the basic shape of the coins. Flattening or reinforcement of the outer surface, as compared with the inner surface, could, for example, provide a base for the holder to stand on.

While there are shown and described present preferred embodiments of the invention, it is to be distinctly understood that the invention is not limited thereto, but may be otherwise variously embodiment and practiced within the scope of the following claims. ACCORDINGLY,

What I claim is:

1. A holder for receiving a number of coins and the like which are stacked on top of one another comprising:

a substantially cylindrical casing having a casing wall and opposed ends;

said cylindrical casing possessing an internal crosssection essentially corresponding to the outer contour of the coins to be inserted;

a rim defining a locating edge provided at each end of the cylindrical casing for forming an end face boundary for limiting said cylindrical casing;

said cylindrical casing being provided with a longitudinal slot extending over the entire length of said cylindrical casing;

the width of said longitudinal slot being less than the diameter of each of the coins to be inserted into said cylindrical casing;

said longitudinal slot being enlarged at least at one of the ends of the casing to form a gripping opening surrounded by the rim at said one end;

said longitudinal slot being bounded by feed strips having inner guide surfaces which open outwards to form sliding surfaces for the coins to be inserted;

the wall and each of the rims of said cylindrical casing being formed at least in part of a flexible material to enable the longitudinal slot to expand to the width of the coins to be inserted at least in predetermined places of said longitudinal slot.

2. The holder as defined in claim 1, wherein:

said cylindrical casing is provided with means forming inspection apertures for viewing the coins inserted into the cylindrical casing.

3. The holder as defined in claim 2, wherein said means forming inspection apertures comprises:

said cylindrical casing being formed of substantially longitudinally and transversely extending strips arranged substantially in the shape of a basket.

4. The holder as defined in claim 1, wherein:

said cylindrical casing is structured to provide a firm press fit for the coins inserted therein.

5. The holder as defined in claim 1, further including:

markings provided on the outside of said cylindrical casing to indicate the number of coins inserted therein.

6. The holder as defined in claim 1, wherein:

said cylindrical casing comprises two longitudinal halves; and means for joining together said two longitudinal halves so that they can open outwardly at a bending zone.

7. The holder as defined in claim 6, wherein:

said means providing the bending zone comprises a hinge formed of one of said two longitudinal halves which is spring-loaded in the direction of the closed position of the cylindrical casing.

* * * * *